United States Patent [19]

O'Brien

[11] 4,033,652

[45] July 5, 1977

[54] BOOK DESK

[75] Inventor: John F. O'Brien, Downers Grove, Ill.

[73] Assignee: The Mercy Hospital and Mercy Orphan Asylum of Chicago, Chicago, Ill.

[22] Filed: Dec. 8, 1975

[21] Appl. No.: 638,296

[52] U.S. Cl. ..... 312/245; 312/209; 312/233; 248/441 B; 248/460

[51] Int. Cl.[2] ..... A47B 63/00

[58] Field of Search ..... 312/245, 233, 209; 248/460, 441 B, 447

[56] References Cited

UNITED STATES PATENTS

| | | | |
|---|---|---|---|
| 327,816 | 10/1885 | Newbourg | 248/460 |
| 337,544 | 3/1886 | Yaggy | 248/460 |
| 1,479,721 | 1/1924 | Liedtke | 312/209 |
| 1,747,480 | 2/1930 | Newell | 312/245 |
| 2,003,482 | 6/1935 | Fancher | 248/441 B |
| 2,386,131 | 10/1945 | McCutchan | 248/447 |
| 2,490,356 | 12/1949 | Hummel | 248/460 |
| 2,587,316 | 2/1952 | Henry | 248/460 |
| 2,814,154 | 11/1957 | Krueger | 248/441 B |
| 3,166,342 | 1/1965 | Yerkes | 248/460 |
| 3,745,736 | 7/1973 | Fischer et al. | 24/214 |

FOREIGN PATENTS OR APPLICATIONS

| | | | |
|---|---|---|---|
| 442,255 | 1936 | United Kingdom | 248/460 |

*Primary Examiner*—Paul R. Gilliam
*Assistant Examiner*—Victor N. Sakran
*Attorney, Agent, or Firm*—Hill, Gross, Simpson, Van Santen, Steadman, Chiara & Simpson

[57] ABSTRACT

A book, such as a loose-leaf binder, containing pages for writing thereon, has a rigid back cover with a hanger at the top edge thereof, and an underlying prop flap hinged to the bottom edge thereof and providing a free edge for engaging a wall, door or the like upstanding support surface to hold the book in a desk simulating position when the hanger is suspended from the surface to thereby present the pages in a comfortable writing position. The hanger is preferably an elongated downwardly opening channel strip secured along the top edge of the back cover to mate with an upwardly opening channel strip secured on the door, wall or the like. The book preferably has a rigid front cover which is also equipped with a similar downwardly opening channel strip to mate in the door or wall mounted strip thereby holding the book in rigid opened position so that both sides of pages may be presented for writing. A second prop flap on the front cover is not necessary.

The book desk is especially useful in the form of a loose-leaf ring binder serving as a patient's record book in hospitals where the book may be kept in a patient's supply cabinet in the patient's room and easily and quickly mounted on a door of the cabinet to provide a desk for use by the doctor or other hospital personnel in entering records. The pages are removed from the binder to form a permanent hospital record when the patient is discharged and the binder is then available for the records of successive patients occupying the room.

4 Claims, 12 Drawing Figures

Fig. 7
Fig. 6
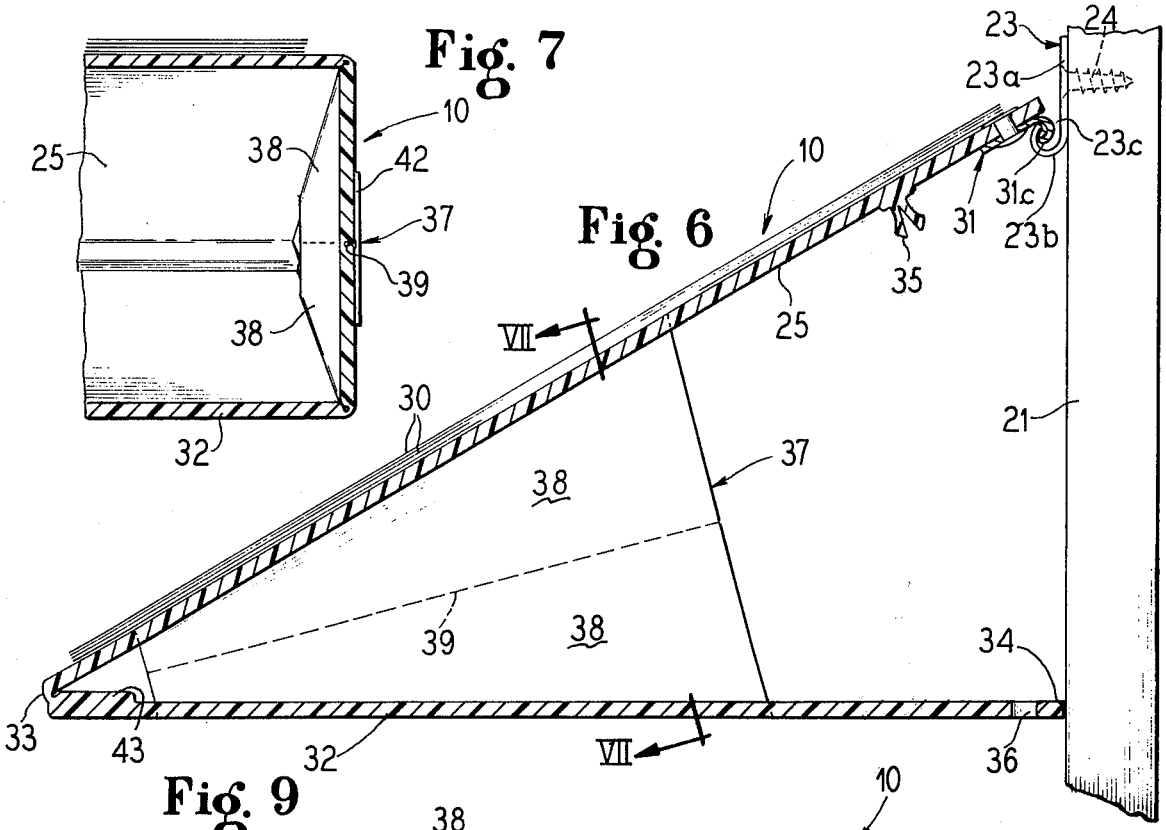
Fig. 9
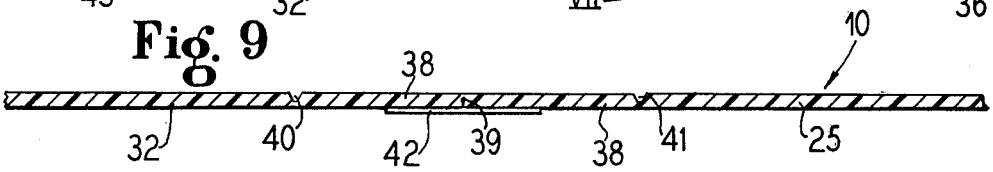
Fig. 8
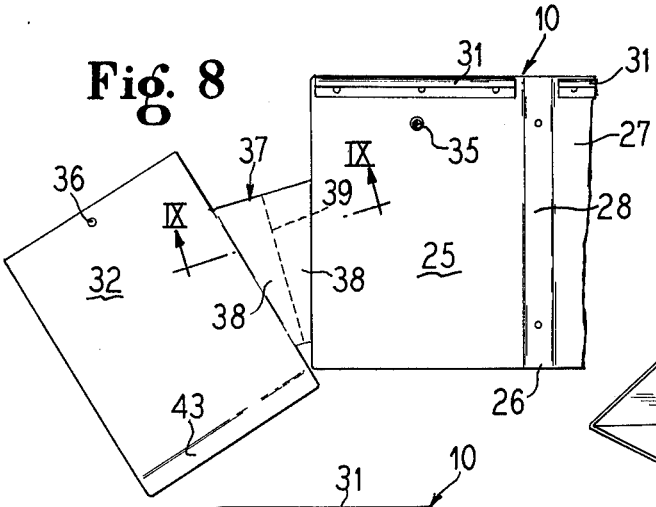
Fig. 11
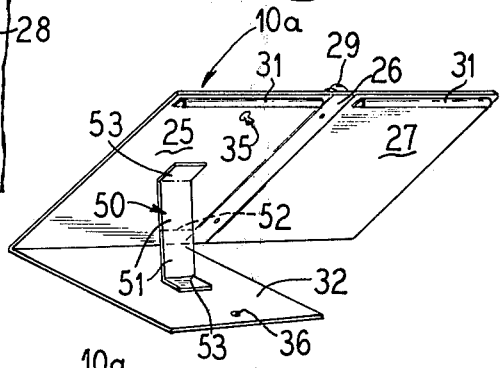
Fig. 10
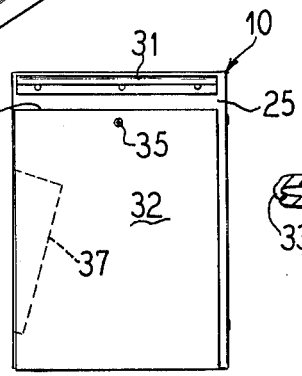
Fig 12
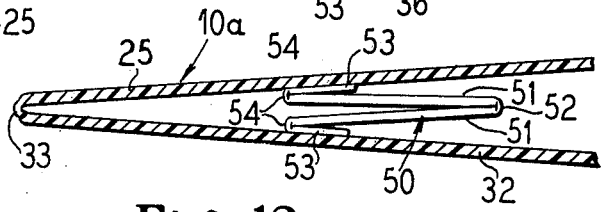

BOOK DESK

FIELD OF THE INVENTION

This invention relates to the art of books and binders and particularly deals with a book or binder that can be releasably hung from a door, wall, bench or the like upright support surface and projected therefrom to provide a rigid, desk base for comfortable writing. The invention is especially useful in the form of a loose-leaf binder for pages forming the record of a patient in a hospital where the binder can be suspended on a door or wall near the patient to project therefrom in opened position and form a desk base for the pages to accommodate comfortable writing on both sides of the pages.

BACKGROUND OF THE INVENTION

Heretofore, hospital patient's records were conventionally kept in a binder mounted in a central station area remote from the patient's bedside thereby enhancing the chances of error in making entries in the wrong books. While these central stations have writing areas, they are frequently so remote from the patient's bedside as to increase the chances of overlooking entries after a nurse or doctor leaves the patient's bedside. On the other hand, storage of the record books in the patient's room can result in disturbing the patient when entries are being made or are being checked. It is also desirable, in some instances, to make entries and check records out of the patient's presence such as in a corridor where no desk support is available and writing is difficult.

SUMMARY OF THIS INVENTION

This invention now provides a loose-leaf binder, entry book, or the like in a form that is easily hung on a wall, door, bench or any upright surface and projected to provide a desk support so that the pages of the binder or book are presented in a comfortable writing and reading position.

The term "book" as used herein is intended to cover bound books, loose-leaf binders, page pockets, clipboards and the like page-carrying devices.

The book desks of this invention, although particularly suitable for hospital use in keeping patients' records, are generally useful in factories, laboratories, warehouses, garages and other areas where record books are used and desk supports for such books are not conveniently available.

According to this invention, a book is provided with a rigid back cover to support pages in the book. The back cover has a hanger at the top edge thereof to be suspended from a wall or door mounting. A rigid prop flap underlies the back cover and is swingable from a collapsed position against the back to an open position below the back for presenting a free edge to engage the wall or door thereby cooperating with the mounting to hold the book outwardly from the door or wall to present the pages on the back cover in a comfortable position to receive writing thereon. The book preferably also has a rigid cover that can be opened up to lie flat in the same plane with the back cover and also having a hanger at the top edge thereof to be suspended in the door or wall mounting thereby presenting a desk surface for pages that are turned over from the back cover.

The hanger for suspending the book desk is preferably a downwardly opening channel strip mounted along the top edge of the book back cover and front cover and the wall or door mounting for this hanger is an upwardly opening channel strip. The downturned leg of the book strips fit in the channel of the door or wall mounted strip and the upturned leg of the door or wall mounted strip fits in the channel of the book mounted strip to provide a hinge-like connection. The book mounted strips are easily dropped into the channel of the door or wall mounted strip.

The prop flap is preferably integrally connected with the bottom edge of the book back through a bendable hinge connection, and the free edge of the flap preferably terminates short of the top edge of the back so that when the book is suspended from the door or wall, the prop will hold the book outwardly in a downwardly inclined position relative to the door or wall presenting the pages at an angle of about 120° from the wall. The prop flap folds tightly against the back face of the back cover and is conveniently held there by a fastener such as a headed stud projecting through a hole near the free edge of the flap. A strap preferably connects the back with the flap to limit the swinging of the free end of the flap to somewhat less than 45°, preferably around 30° to hold the flap perpendicularly to the wall or door. The strap is preferably formed so as to spring open from a closed folded position so as to hold the flap in fixed spaced relation from the backing.

It is then an object of this invention to provide a book adapted to be hung on a wall or door and project therefrom to present its pages in a comfortable position for writing thereon.

Another object of the invention is to provide a book with a hanger and a back flap cooperating to suspend the book from a vertical surface to form a desk support.

Another object of the invention is to provide a binder with rigid front and back covers connected by an intermediate backing section accommodating opening of the binder to present the front and back covers in the single plane and having a downwardly opening mounting strip for hanging the binder on a wall-mounted upwardly opening channel strip together with a rigid prop flap underlying the back cover and hinged to the bottom edge of the cover to present a free top edge adapted to engage the wall surface on which the binder is suspended so that the binder will project outwardly from the wall surface to present pages in the binder at a comfortable writing position.

A specific object of the invention is to provide a hospital patient's record book adapted to be suspended from a wall and projected therefrom in a comfortable writing position.

Other and further objects of the invention will be apparent to those skilled in this art from the following detailed description of the annexed sheets of this invention which show preferred embodiments of the invention.

ON THE DRAWINGS

FIG. 6 is a side cross-sectional view of the book desk mounted on a door and taken generally along the line VI—VI of FIG. 3.

FIG. 7 is a fragmentary cross-sectional view taken along the line VII—VII of FIG. 6.

FIG. 8 is a fragmentary bottom plan view of the book desk showing the manner in which the prop flap can be formed integrally with the back cover through the strap hinge.

FIG. 9 is a cross-sectional view taken generally along the line IX—IX of FIG. 8.

FIG. 10 is a bottom plan view of the book desk.

FIG. 11 is a perspective view of the back side of a book desk equipped with a modified hinge strap in its opened position.

FIG. 12 is a side elevational view of the book desk of FIG. 11 in a partially closed position showing the manner in which the hinge strap folds.

AS SHOWN ON THE DRAWINGS

Figure 1:
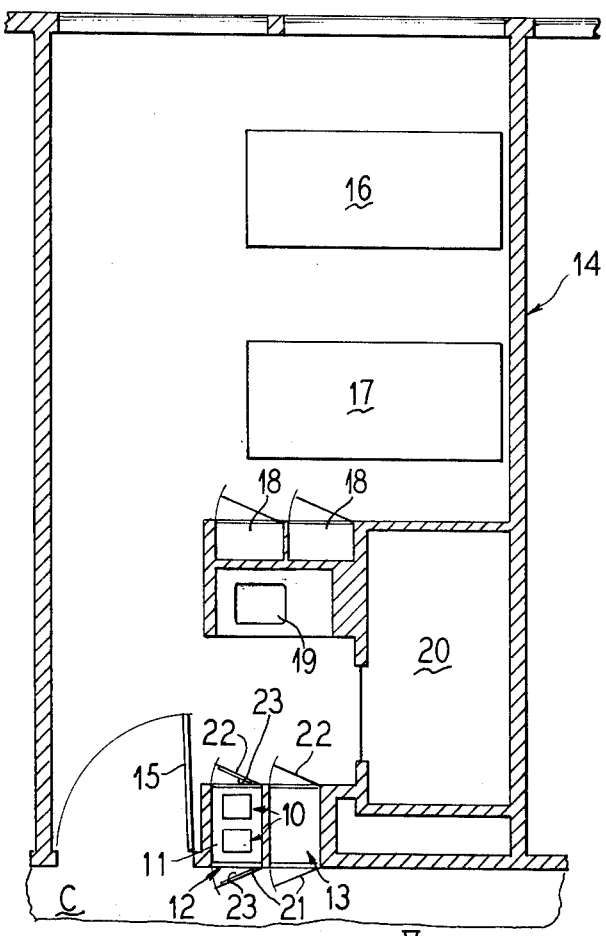
FIG. 1 is a diagrammatic plan view with parts in horizontal section of a hospital room with patient's supply cabinets adapted to store and mount the book desks of this invention.
Figure 2:
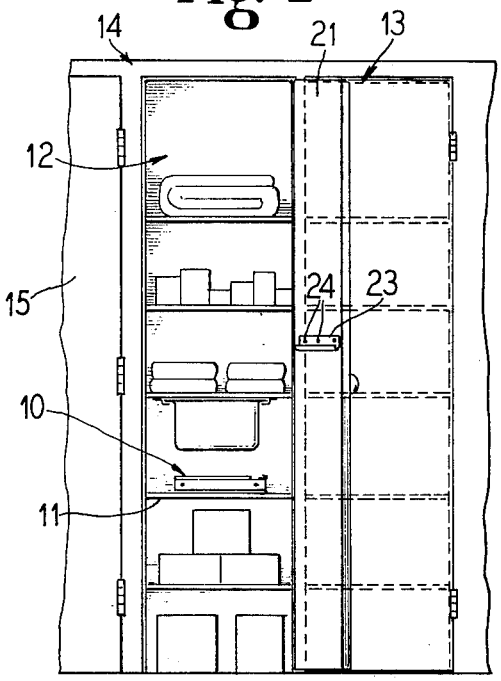
FIG. 2 is a fragmentary elevational view of the patient's supply cabinets of FIG. 1 and illustrating a mounting on a door of one of the cabinets for suspending the book desk of this invention.

The book desk 10 of FIGS. 1–10 may, as shown in FIGS. 1 and 2, be stored in a closed position on a shelf 11 of a patient's supply cabinet 12 for clean incoming supplies which is adjacent a similar cabinet 13 for outgoing supplies. The cabinets or supply stations 12 and 13 are part of a hospital bedroom 14 with an entrance door 15 from a corridor C. The illustrated room 14 has beds 16 and 17 for two patients, clothing storage lockers 18 for the patients, a wash basin stand 19 and a bathroom 20. The supply stations 12 and 13 each have an outer door 21 swinging open into the corridor C and an inner door 22 swinging inwardly into the room area. Supplies for the patients are introduced into the cabinet 12 from the corridor through an open door 21 and are removed into the patients' area from the cabinet through an open door 22. Similarly supplies to be discarded from the patients' room are deposited into the cabinet 13 from an open door 22 and removed from this cabinet through an open door 21.

Figure 3:
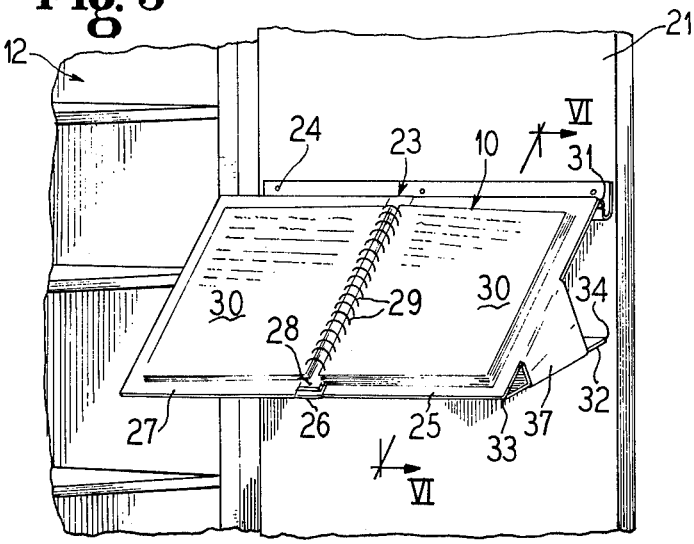
FIG. 3 is a fragmentary perspective view of a portion of a cabinet of FIG. 2 showing the book desk of this invention suspended on the inner surfafce of the corridor door for the cabinet.
Figure 5:
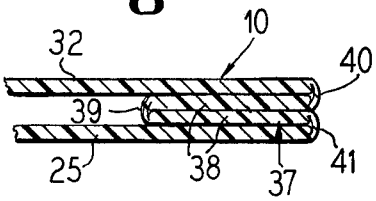
FIG. 5 is a fragmentary vertical sectional view along the line V—V of FIG. 4.

As shown in FIGS. 1, 2 3 and 6, the inner surface of the door 21 for the cabinet 12 has an elongated upwardly opening channel strip 23 secured thereon by means of fasteners such as screws 24 to extend horizontally across the width of the door at a level convenient for suspending the book desk 10 of this invention at a comfortable writing height. The channel strip 23, as best shown in FIGS. 3 and 6, has a flat portion **23*a* adapted to lay against the door 21 and an out-turned and upturned bottom end 23*b* defining an upwardly opening channel 23*c* along the length of the strip. As shown in FIG. 1, a channel strip 23 is also mounted on the inner surface of the inner door 21 of cabinet 12**.

Figure 4:
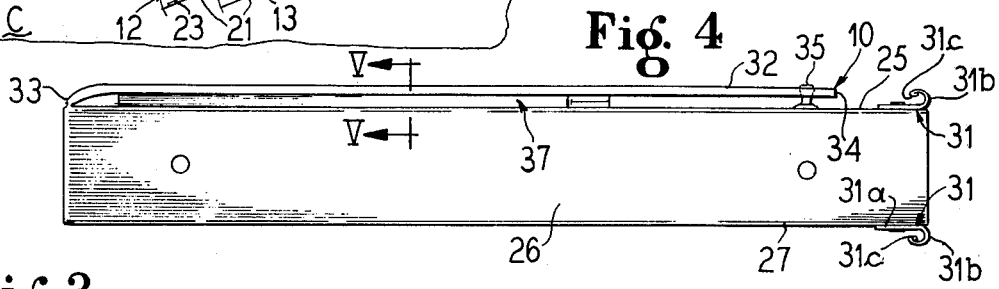
FIG. 4 is a rear end elevational view of the book desk of this invention in its closed position.

The book desk 10 of this invention is illustrated in the form of a loose-leaf ring binder, but as explained above, the invention includes any form of book or page support device. As shown in FIGS. 3, 4 and 6, the book desk 10 has a rigid back cover 25, a backing 26, and a rigid front cover 27. The backing carries along its inner face a mounting strip 28 for split rings 29 threaded in perforations of pages 30 to form a loose-leaf binder for these pages. The covers 25 and 27 are hinged to the backing 26 to swing from the closed position of FIG. 4, covering the pages 30 to the open position of FIG. 3 wherein the covers and backing all lie in the same flat plane.

A channel strip 31 is secured to the bottom face of the back cover 25 adjacent the top edge thereof to extend across the width of the back cover. A similar channel strip 31 is secured to the top face of the front cover 27 adjacent the top edge thereof. The strips 31, like the strip 23, have flat portions **31*a* overlying the covers and out-turned and downturned hook-like ends 31*b* defining downwardly opening channels 31*c*. As shown in FIGS. 3 and 6 the strips 31 provide hangers for suspending the book 10 from the mounting strip 23 and both strips 31 fit in the channel 23*c*** of this mounting strip, thus forming a hinge-like suspension for the book desk.

The bottom covers 25 has a rigid prop flap 32 underlying the bottom face of the back cover and hinged to the bottom edge of the cover at 33. The prop flap 32 has a fee top edge 34 adapted to thrust against the door 21 as will be more fully hereinafter described.

A split resilient headed stud 35 depends from the bottom of the back cover 25 at about the center of the cover and spaced below the strip 31. A hole 36 is provided through the prop flap 32 to receive the stud 35 and hold the prop flap in underlying relation to the back cover as shown in FIG. 4. The prop flap can be pulled off the stud to swing to its opened position shown in FIG. 6.

A hinge strap 37 connects the outer side edges of the back cover 25 and prop flap 32 to limit the swinging movement of the prop flap. A hinge strap 37 includes a pair of rigid gussets 38 of generally triangular shape hinged to each other along an outwardly opening crease line 39 and respectively hinged along inwardly opening fold lines 40 and 41 to the prop flap 32 and back cover 25. The fold line 39 opens outwardly while the fold lines 40 and 41 open inwardly so that when the prop flap 32 is released from the stud 35, the hinge strap 37 will tend to snap to an open position with its gussets 38 aligned with each other as shown in FIGS. 6 and 7. When the prop flap 32 is held in its closed position, the gussets 38 fold to the collapsed position of FIG. 5 inwardly from the outer side edges of the prop flap 32 and back cover 25. A flexible strip 42 overlies the outwardly opening fold line or cut 39 to prevent the gussets from bending outwardly from the position of FIG. 7. It will be noted from FIG. 9 that the fold lines 40 and 41 have relatively open V shapes while the fold line 39 has closed sides which are deformed, thereby creating a bias on the gussets 38 causing them to pop open to lie in a single plane when the prop flap is released from the stud 35.

As illustrated in FIGS. 8 and 9, the back cover 25 can be formed integrally with the prop flap 32 through the hinge strap 37 and a front cover 27 can be formed integrally with the back cover 25 through the backing 26. For this type of fabrication the bottom edge of the back cover 25 is connected through the hinge 33 with a strip 32 that is fixed to the inner face of the prop flap 32 along the bottom edge thereof. This arrangement provides for the integral molding or rigid plastic sheet material or the cutting of rigid cardboard material to form a one-piece book, prop and strap assembly.

As shown in FIG. 10, the prop flap 32 substantially covers the entire bottom face of the back cover 25, but terminates short of the mounting strip 31 with its free edge 34 paralleling this mounting strip.

From the above descriptions, it will be understood that the book desk 10 of this invention is easily available for storage in any convenient area with its prop flap in closed collapsed position to occupy very little additional space than the book itself and then hung on a door or wall mounting in a flat opened position with its prop flap extending to provide a rigid brace engaging the wall or door and cooperating with the mounting to hold the book in a position projecting from the wall or door. A hinge strap determines the extent of swinging movement of the prop flap to cooperate with the free edge of the flap so that the book will project at any desired angle from the wall or door. Usually the prop flap need only swing at the 30° angle from the back cover of the book to project the book at a comfortable writing angle. It will also be understood that the single channel strip mounted on the door or wall accepts channel mounting strips of both the back and front covers of the book to hold them in an opened single plane condition whlle the prop flap on the back cover will support both the front and back covers in the projected position from the wall.

It will be understood that the book desk of this invention is especially adapted for use in hospitals as a patient's record book where it can be stored in a closed easily accessible position in a patient's supply station and then selectively mounted in an opened desk position on the doors of the service station to be accessible from either the corridor or the hallway alongside the patient's room or in the room area to receive entries by hospital personnel.

As shown in FIGS. 11 and 12, a modified book desk 10*a* of this invention has the same front and back cover, mounting strips, and prop flap as the book 10 described above, but a modified hinge strap 50 is provided at the center instead of the edges of the bottom cover and prop flap. The hinge strap 50 is composed of two rigid gusset sections 51 joined by a bendable fold hinge 52 at their inner-adjacent ends and connected at their outer ends to tabs 53 which are secured to the adjoining faces of the back cover 25 and prop flap 32. A hinge fold 54 opening opposite to the fold 52 connect the flaps 53 with the gussets 51 and the arrangement is such that the hinge 50 will snap to an open position with its gussets 51 in a single plane aligned to hold the prop flap 32 away from the back cover 25. In this arrangement the prop flap 32 may be connected integrally to the back cover 25 along the hinge line 33 since the hinge strap 52 is formed separately from the prop flap and back cover. The book desk 10*a* operates in the same manner as the book desk 10.

It will be readily appreciated to those skilled in this art that other forms of hangers, prop flaps, and hinge straps can be used and that this invention encompasses any book or device for supporting pages which carries a hanger and a prop so that the book or device may be hung on a wall or door with the prop cooperating with the hanger to project the book or device from the door or wall holding the pages supported thereby in a comfortable writing or reading position.

I claim as my invention:

1. In a patient's supply cabinet for a hospital bedroom having doors opening to a corridor outside the room and to the interior of the room with shelves between the doors, the improvements of a patient's record book adapted to be stored on one of said shelves, said book having a side backing, front and back covers hinged to said side backing, and pages removably mounted on said side backing between said covers adapted to receive writing on both the front and back sides thereof, an elongated horizontal upwardly opening channel strip mounted on the inner face of at least one of the doors of said cabinet, a cooperating downwardly opening channel strip on both covers of the book interfitting with said upwardly opening channel strip to suspend the book from the door in an open position with the covers of the book in a flat plane for selectively supporting the front and back sides of the pages, a prop flap hinged to a cover of the book for underlying said cover and having a free end edge for engaging the door from which the book is suspended to project the book from the door in a flat planar open position for comfortable writing on both sides of the pages.

2. A side opening stiff cover book adapted to be detachably hinged to an upright wall or the like which comprises a side backing, front and back rigid covers hinged to said backing, pages releasably mounted on said backing between said covers adapted to receive writing on both sides thereof, said book opening to a flat plane to expose the pages thereof selectively supported by said front and back covers, hangers at the top edges of both said front and back cover to hingedly suspend the open book from a corresponding hanger on an upright wall, a stiff prop flap hinged to the outside of one of the covers of the book having a free edge to engage the wall support surface, said prop flap and hangers cooperating to project the open book from the wall surface to provide a flap planar writing desk support for both sides of the pages of the book, and means for releasably holding said prop flap against the cover of the book on which it is hinged.

3. A book desk unit adapted to be removably suspended from a wall, door, bench or the like vertical support surface which comprises a book having a backing and a rigid back cover, pages mounted on said backing, a first downwardly opening hanger on said back cover, a second upwardly opening hanger for attachment to a support surface releasably receiving said first hanger, a rigid prop flap underlying the back cover and hinged thereto to swing therefrom, said prop flap having a free end edge adapted to engage a support surface to cooperate with the hangers to hold the book in a projected position from the support surface, with the pages supported on said back cover, and a strap secured to the prop flap and back cover limiting the swinging movement of the prop flap relative to the back cover wherein the strap has foldable rigid gusset flaps springing to an open single plane position to hold the prop flap with its free edge spaced from the back cover a preselected distance to control the angle of projection of the unit from the vertical support surface.

4. A book desk unit adapted to be removably suspended in a comfortable writing position from a mounting on an upstanding support surface which comprises a book having pages adapted to receive writing on both sides thereof and a rigid backing for both sides of said pages, a downwardly opening hanger on said backing adapted to releasably engage an upwardly opening mounting on a support surface to hingedly suspend the book from the surface, a rigid prop flap underlying said backing and having a free top end edge, means swingably mounting said rigid prop flap on said backing to move from a collapsed position against the backing to an open position with said free end edge thereof spaced below the hanger for engaging the support surface, and said prop flap and hanger cooperating to rigidly project the backing from the support surface to present both sides of the pages in a comfortable writing position.

* * * * *

UNITED STATES PATENT AND TRADEMARK OFFICE

CERTIFICATE OF CORRECTION

PATENT NO. : 4,033,652

DATED : July 5, 1977

INVENTOR(S) : John F. O'Brien

It is certified that error appears in the above-identified patent and that said Letters Patent are hereby corrected as shown below:

Column 4, line 17, change "cover" to --covers--;

Column 4, line 20, cancel "fee" and insert --free--;

Column 4, line 60, cancel "32" and insert --43--;

Column 4, line 63, cancel "or" and insert --of--;

Column 5, line 19, cancel "whlle" and insert --while--; and

Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*